US005257899A

United States Patent [19]

Asakura et al.

[11] Patent Number: 5,257,899

[45] Date of Patent: Nov. 2, 1993

[54] TRANSFER FEEDER

[75] Inventors: Haruo Asakura; Kiyokazu Baba, both of Komatsu, Japan

[73] Assignee: Komatsu Ltd., Tokyo, Japan

[21] Appl. No.: 834,314

[22] PCT Filed: Jun. 14, 1991

[86] PCT No.: PCT/JP91/00804

§ 371 Date: Feb. 14, 1992

§ 102(e) Date: Feb. 14, 1992

[87] PCT Pub. No.: WO91/19577

PCT Pub. Date: Dec. 26, 1991

[30] Foreign Application Priority Data

Jun. 15, 1990 [JP] Japan ..... 2-62796[U]
Jun. 15, 1990 [JP] Japan ..... 2-62797[U]
Oct. 30, 1990 [JP] Japan ..... 2-113035[U]

[51] Int. Cl.[5] ..... B65G 25/00
[52] U.S. Cl. ..... 414/752; 198/468.4
[58] Field of Search ..... 414/733, 752, 749; 198/468.4; 74/53

[56] References Cited

U.S. PATENT DOCUMENTS 4,523,889 6/1985 Orii ..... 901/12 X
4,995,505 2/1991 Takahashi et al. ..... 198/468.4

FOREIGN PATENT DOCUMENTS 58-47529 3/1983 Japan .
2-52128 2/1990 Japan .
2-37463 10/1990 Japan .
2-46291 10/1990 Japan .
2-284731 11/1990 Japan .
2-299729 12/1990 Japan .
3-5030 1/1991 Japan .

*Primary Examiner*—Michael S. Huppert
*Assistant Examiner*—Donald W. Underwood
*Attorney, Agent, or Firm*—Armstrong, Westerman, Hattori, McLeland & Naughton

[57] ABSTRACT

The object of the invention is to provide a transfer feeder capable of moving a transfer bar with a small driving force. In the transfer feeder, a transfer bar having workpiece holding elements, i.e. vacuum caps, is transversely disposed and supported by a link rotatably attached to a feed carrier which travels freely along a feed rail. A feed lever and a lift lever are rocked by cams rotatable in synchronism with the operations of a transfer press. A plurality of feed carriers are connected to one another by a feed equalizing bar connected to the feed lever. A lift equalizing bar connected to the lift lever is connected to the link thus attached to the feed carrier. The transfer bar supported by the link mechanism is moved up and down to feed a workpiece, thereby performing accurate conveyance of workpieces with a small driving force.

9 Claims, 5 Drawing Sheets

TRANSFER FEEDER

TECHNICAL FIELD

This invention relates to a transfer feeder for use with a transfer press for conveying workpieces.

BACKGROUND ART

In one known type of transfer feeder incorporated in a transfer press and intended for conveying workpieces (mainly steel sheets) from one process station to another in the transfer press, workpiece suction means such as vacuum cups are employed and a workpiece is conveyed being absorbed by them.

Transfer feeders employing such workpiece suction means have been disclosed, for example, in Japanese Patent Publication No. 46291/1990; Japanese Patent Applications Laid Open Nos. 284731/1990, 299729/1990, 5030/1991; and Japanese Utility Model Publication No. 37463/1990.

In these known transfer feeders, in order to successively convey workpieces from one process station to another, it is necessary to synchronize the conveyance of each workpiece. Therefore, these known transfer feeders include a long beam on which a plurality of transfer bars having workpiece holding means such as suction cups are spaced at given intervals, and the operation for vertically moving all the transfer bars (cross bars) at a time and the operation for conveying workpieces by a specific distance are accomplished by such a construction that the long beam is connected, at one end thereof, to a rocking lever which is driven by a cam. In most of these transfer feeders, a gear mesh driving mechanism is used in combination with the above arrangement for the vertical or transverse movement of the beam.

Such conventional transfer feeders incorporated in a (1) Since a plurality of transfer bars are moved up and down with the help of a long heavy beam, a considerable torque is generated on a cam shaft of a lift cam in the driving mechanism when the transfer bars are lifted. This requires a large driving force.

(2) When moving a plurality of transfer bars vertically, side play vibration occurs on a lift rod for supporting the long heavy beam, decreasing accuracy in positioning workpieces to be conveyed or causing noise.

(3) Further, dummy cams are required for eliminating the aforementioned undesirable torque generated on the lift cam shaft. This disadvantageously increases the manufacturing cost of a driving mechanism.

(4) High fabrication accuracy is required because of the provision of a gear meshing mechanism at a vertical driving region and at a transverse driving region for conveyance. This increases the manufacturing cost of a transfer feeder.

DISCLOSURE OF INVENTION

In consideration of the foregoing problems, the present invention aims to provide a transfer feeder of a simple structure which allows the moving operation of transfer bars with a small driving force.

According to the invention, a transfer feeder comprising a system for lifting and lowering workpieces by means of a cam the rotation of which synchronizes with the operations of a transfer press and a system for forwarding the workpieces lifted by the lifting and lowering system to the following process station is characterized in that: a plurality of feed carriers are arranged to travel freely along a feed rail and connected at given intervals by means of a feed equalizing bar, the feed carriers each have a bell crank shaped link rotatably attached thereto, the link supports one end of a transfer bar having workpiece holding means and is connected, at an adequate position thereof, to a lift equalizing bar arranged along the feed rail by means of a pin, one end of the feed equalizing bar is connected to the upper end of a feed lever, and one end of the lift equalizing bar is connected directly or through a relay link to a lift lever.

Preferably, the feed lever and the lift lever are arranged such that they are rocked by means of corresponding cams respectively within a required rotation range and are so disposed that they face each other. It is also preferable that the feed carriers freely movable along a feed rail are each provided with a bell crank shaped link the bent base part of which is pivotally attached thereto and that one end of the bell crank shaped link is pin-connected to one end of the transfer bar having workpiece holding means while the other end thereof is pin-connected to the lift equalizing bar. Alternatively, another link may be disposed in parallel to one side of the bell crank shaped link, and one end of the link is pivotally fixed to the feed carrier while the other end is connected to one end of the bell crank shaped link via a connecting link. The connecting link is attached, at the mid position thereof, to one end of the transfer bar having workpiece holding means.

Further it is preferable that the upper end of the lift lever and one end of the lift equalizing bar are connected thorough a connecting rod to either the mid position or lower end of a rocking link which is pivotally attached to the feed lever at either the mid position or lower end thereof.

According to the invention described above, rocking movement of the feed lever causes the feed carriers, which are connected through the feed equalizing bar to the feed lever, to travel on the feed rails, and the bell crank shaped links attached to the feed carriers are all rotated synchronously by means of the lift equalizing bar connected to the lift lever, thereby allowing the transfer bar to move up and down. With such an arrangement, it becomes unnecessary to employ a long heavy lift beam conventionally used, and the lifting, lowering and feeding operations of workpieces can be easily performed with a small driving force.

Further, the feed lever and the lift lever operated by the feed cam and the lift cam respectively are disposed so as to face each other. This arrangement allows undesirable torques of these cams to be substantially offset by each other. As a result, smooth driving operation can be achieved without dummy cams conventionally used for eliminating reactive force.

BRIEF DESCRIPTION OF THE DRAWINGS

The invention will now be described by way of example with reference to the accompanying drawings which illustrate the embodiments of a transfer feeder of the invention and in which.

BEST MODE FOR CARRYING OUT THE INVENTION

With reference to the drawings, the embodiments of a transfer feeder of the invention will be explained.

Figure 1:
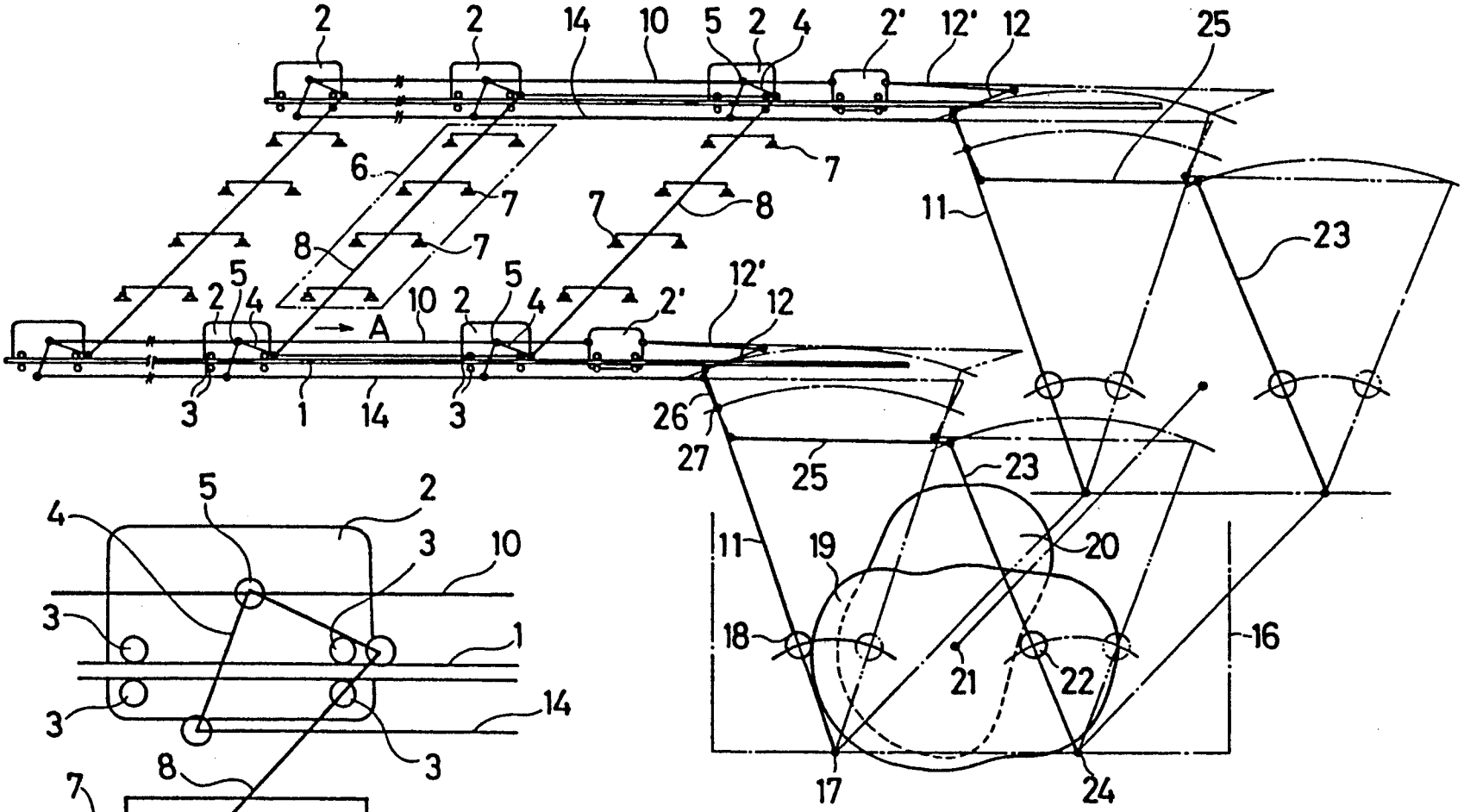
FIG. 1 is a schematic diagram of the structure of a first embodiment of the invention.

Referring now to FIG. 1, there is seen a first embodiment of a transfer feeder according to the invention. In a transfer press (not shown in the drawing), a pair of feed rails 1 are juxtaposed, extending in a feeding direction (indicated by the arrow A) within a required section. These rails 1 are fixed to an upright post etc. of the transfer press with a supporting girder (not shown). On the feed rails 1, multiple pairs of feed carriers 2 are spaced at given intervals in such a manner that they can freely travel.

Figure 2:
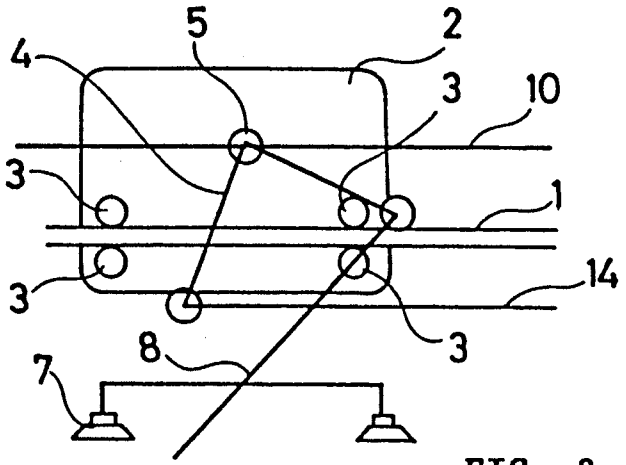
FIG. 2 is an enlarged view of the structure of a link mechanism provided in a feed carrier.

The feed carriers 2 has, as shown in FIG. 2, at least two pairs of guide rollers 3 at the bottom part thereof so as to receive the feed rail 1 therebetween in a vertical direction. The provision of these guide rollers 3 allows the feed carrier 2 to travel freely along the guide rail 1. The inner face of the feed carrier 2 is provided with a bell crank shaped link 4 which is pivotally attached with a pin 5 to the feed carrier 2 at the bent base part thereof.

There is a transfer bar 8 transversely spanned between the bell crank shaped links 4 of two opposite feed carriers 2 mounted on the pair of rails 1, each end of the transfer bar 8 being pivotally supported at one end (namely, the upper end ) of the link 4. The transfer bar 8 has a plurality of workpiece holding means 7 such as vacuum cups for absorbing and holding a workpiece 6. The workpiece holding means 7 may be of the clamp type depending on the type of the workpiece 6 to be processed. In this embodiment, the workpiece 6 is a sheet material and illustrated in rectangular form with two-dot chain lines in the drawing.

The pins 5, each of which is pivotally attached to the bell crank shaped link 4 of the feed carrier 2, are coupled to one another by means of a feed equalizing bar 10 so that all the feed carriers 2 travel as one unit in the feeding direction A. A feed carrier 2' positioned in the downmost stream, which does not have the link 4 for operating the transfer bar 8 in this embodiment, is connected through connecting rods 12, 12' to the upper end of a feed lever 11. The other ends of the bell crank shaped links 4 are pin-connected to one another by means of a lift equalizing bar 14, and the downstream end of the lift equalizing bar 14 is pivotally attached to the upper end of a rocking link 26.

The feed lever 11 is housed in a cam box 16 positioned at the downstream, the lower end of which being pivotally supported by a pin 17 at the bottom of the cam box 16.

The feed lever 11 is provided with a cam follower 18 at the lower end side thereof. The cam follower 18 comes in contact with a feed cam 19 mounted on a cam shaft 21 which is rotated by a driving force supplied from the transfer press (not shown), and then the rotation of the feed cam 19 causes the upper end of the feed lever 11 to rock on the pin 17 in the feeding direction A.

A lift cam 20 is mounted on the cam shaft 21 together with the feed cam 19 and is brought in contact with a cam follower 22 at the side opposite to the contacting side of the feed lever 11, the cam follower 22 being positioned at the lower end side of a lift lever 23. The lift lever 23 is positioned behind and in parallel with the feed lever 11 (i.e., at the downstream of a conveying direction of the workpieces 6) with the cam shaft 21 in-between. The lower end of the lift lever 23 is pivotally attached to the bottom of the cam box 16 with a pin 24 such that the upper end side of the lift lever 23 is rocked on the pin 24 in the feeding direction A as the lift cam 20 rotates, whilst the upper end of the lift lever 23 is connected through a connecting rod 25 to the lower end of the rocking link 26.

The mid position of the rocking link 26 is pivotally attached to the upper end side of the feed lever 11 with a pin 27 such that the upper end side of the rocking link 26 is rocked on the pin 27 in the feeding direction A by means of the lift lever 23. Pivotally attached to the upper end of the rocking link 26 is the downstream end of the lift equalizing bar 14.

The operation of the transfer feeder having the above arrangement will be explained. As the cam shaft 21 is rotated by a driving force supplied from the transfer press, the feed cam 19 and the lift cam 20 rotate at the same time. The rotation of the lift cam 20 mounted on the cam shaft 21 is transmitted to the lift lever 23, causing the connecting rod 25 and the upper end side of the rocking link 26 to rotate downstream. Then, the lift equalizing bar 14 connected to the upper end of the rocking link 26 is pulled downstream. By the movement of the lift equalizing bar 14, the bell crank shaped link 4 provided in each feed carrier 2 rotates counterclockwise on the pin 5, thereby lifting the transfer bar 8 attached to the end of the link 4.

By the above operation, the workpiece 6 is absorbed and lifted by means of the workpiece holding means 7 which is attached to the transfer bar 8 and is already made in an operable condition.

As the upper end of the feed lever 11 is rocked downstream by the feed cam 19 after the workpiece 6 is lifted, the feed carriers 2, which are coupled to one another by means of the feed equalizing bar 10 connected to the feed lever 11, move synchronously toward the downstream. The forwarding operation is thus under way.

At that time, the lift lever 23 is rocked by the lift cam 20 as much as the feed lever 11. Therefore, the workpiece 6 absorbed by the workpiece holding means 7 can travel maintaining the same level as originally lifted.

Immediately after one of the feed carriers 2 reaching its travelling end, the rocking of the feed lever 11 is suspended, causing each feed carrier 2 to stop at its own position, and then the lift lever 23 is rocked upstream by the lift cam 20. More specifically, the feed lever 11 and the lift lever 23 are connected to each other at the upper ends thereof by the connecting rod 25 but the connecting rod 25 is connected to the feed lever 11 via the rocking link 26 the mid position of which is pivotally attached to the feed lever 11, and this arrangement allows the rocking link 26 to rotate in its returning direction (i.e., rocking upstream), even when the feed lever 11 is fully rotated. Therefore, the link 4 attached to the feed carrier 2 is rotated clockwise by means of the lift equalizing bar 14 and then the transfer bar 8 is lowered, thereby forwarding the workpiece 6 to the following process station.

After the workpiece holding means 7 releasing the workpiece 6, the feed lever 11 and the lift lever 23 rock upstream owing to the rotation displacement of the feed cam 19 and the lift cam 20, and then each feed carrier 2 starts its return operation and moves back to its initial position.

The workpieces 6 can be successively conveyed from one process station to another by repeating the above operation in synchronism with the operations of the transfer press. Incidentally, the press process operation is performed when the transfer bar 8 is on the way to the next process station.

Figure 3:
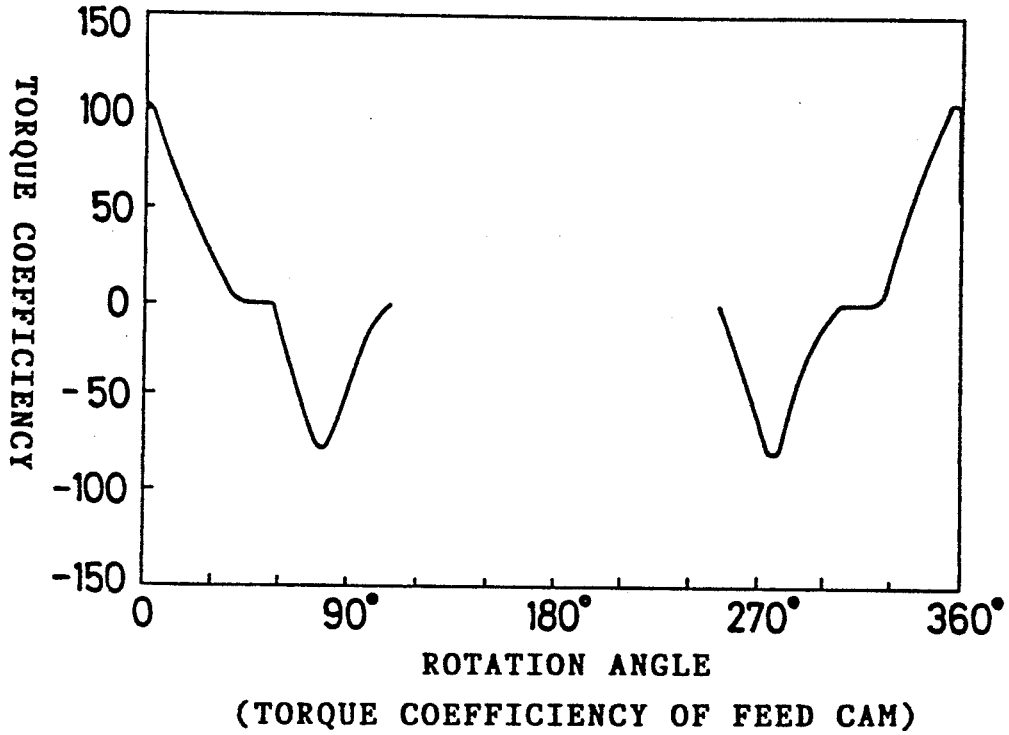
FIG. 3 is a graph showing the torque coefficient of a feed cam.
Figure 4:
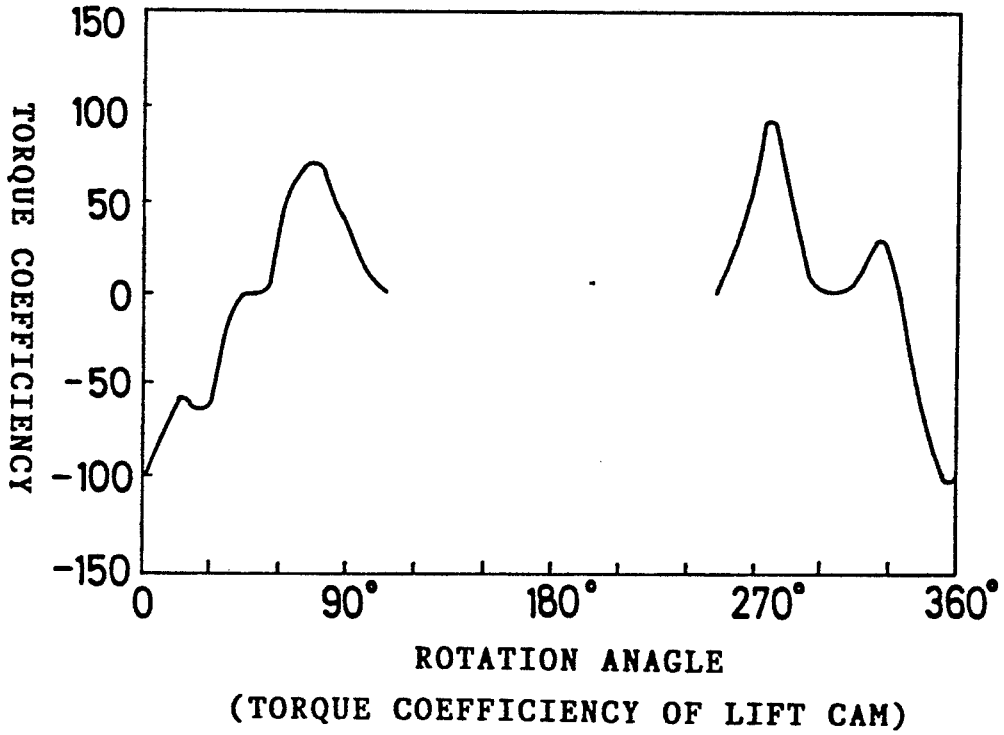
FIG. 4 is a graph showing the torque coefficient of a lift cam.

FIG. 3 shows the torque coefficient of the feed cam 19 of the above embodiment. FIG. 4 shows the torque coefficient of the lift cam 20 of the same. As apparent from these graphs, the torque coefficient of the feed cam 19 is the reverse of that of the lift cam 20 in respect of phase, and they are substantially equal so that their working torques during the operation are offset by each other. Therefore, dummy cams for eliminating reactive force, which have been conventionally used, are no longer necessary.

Figure 5:
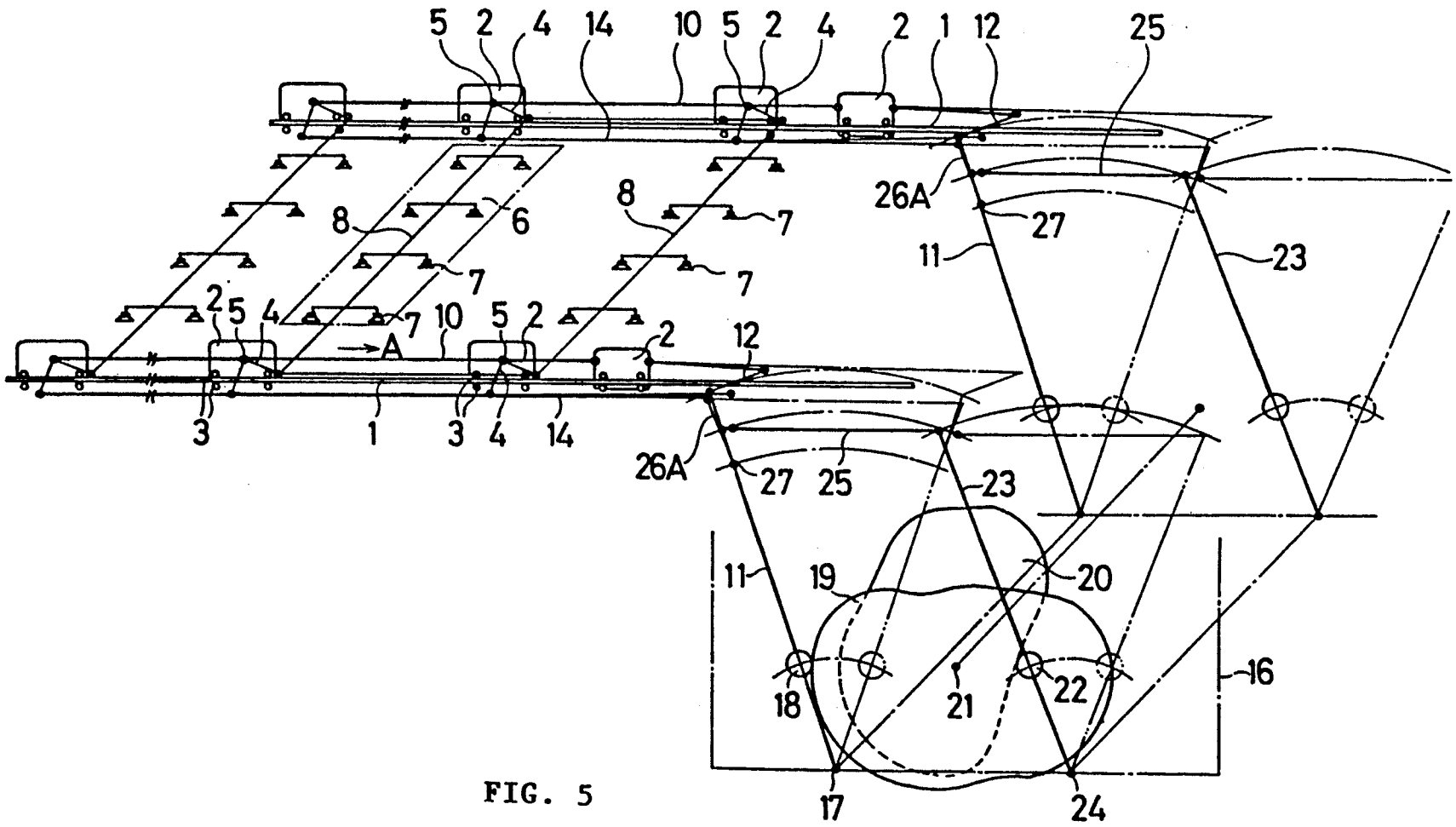
FIG. 5 is a schematic diagram of the structure of a second embodiment of the invention.

FIG. 5 shows a second embodiment of a transfer feeder according to the invention in which the feed cam 19, the feed lever 11, the feed equalizing bar 10, the feed carriers 2 coupled to the feed equalizing bar 10, the bell crank shaped link 4 attached to the feed carrier 2 by the pin 5, the transfer bar 8 transversely disposed between the links 4, the lift cam 20 and the lift lever 23 are arranged in much the same way as those of the first embodiment. Therefore, these members are indicated by the same reference numerals as those for their equivalents in the first embodiment.

The upper end of the lift lever 23 is connected through the connecting rod 25 to the mid position of a rocking link 26A. The lower end of the rocking link 26A is pivotally attached to the upper end of the feed lever 11 with the pin 27 such that the upper end side of the rocking link 26A is rocked on the pin 27 in the feeding direction A by the lift lever 23. The downstream end of the lift equalizing bar 14 is pivotally attached to the upper end of the rocking link 26A.

According to the second embodiment, like the first embodiment, the feed cam 19 and the lift cam 20 are rotated through the cam shaft 21 by a driving force supplied from the transfer press (not shown), and when rocking movement of the lift lever 23 and rocking movement of the feed lever 11 are performed in a given order thereby to convey the workpiece 6, the pin 27 (the supporting point for rotation) is positioned at the lower end of the rocking link 26A which is attached to the feed lever 11 and operated through the connecting rod 25 coupled to the lift lever 23. Therefore, the rocking angle of the lift lever 23 rocked by the rotation of the lift cam 20 can be reduced. By making the rocking angle of the lift lever 23 equal to that of the feed lever 11, the level of the transfer bar 8 lifted by the links 4 (i.e, the lifting level of the workpiece 6) can be made higher.

As understood from FIGS. 3 and 4, in the basic construction of the second embodiment, the torque coefficient of the feed cam 19 is the reverse of the torque coefficient of the lift cam 20 in respect of phase and they are substantially equal like the first embodiment. This allows them to be offset by each other and enables smooth operation to be achieved without using dummy cams.

Figure 6:
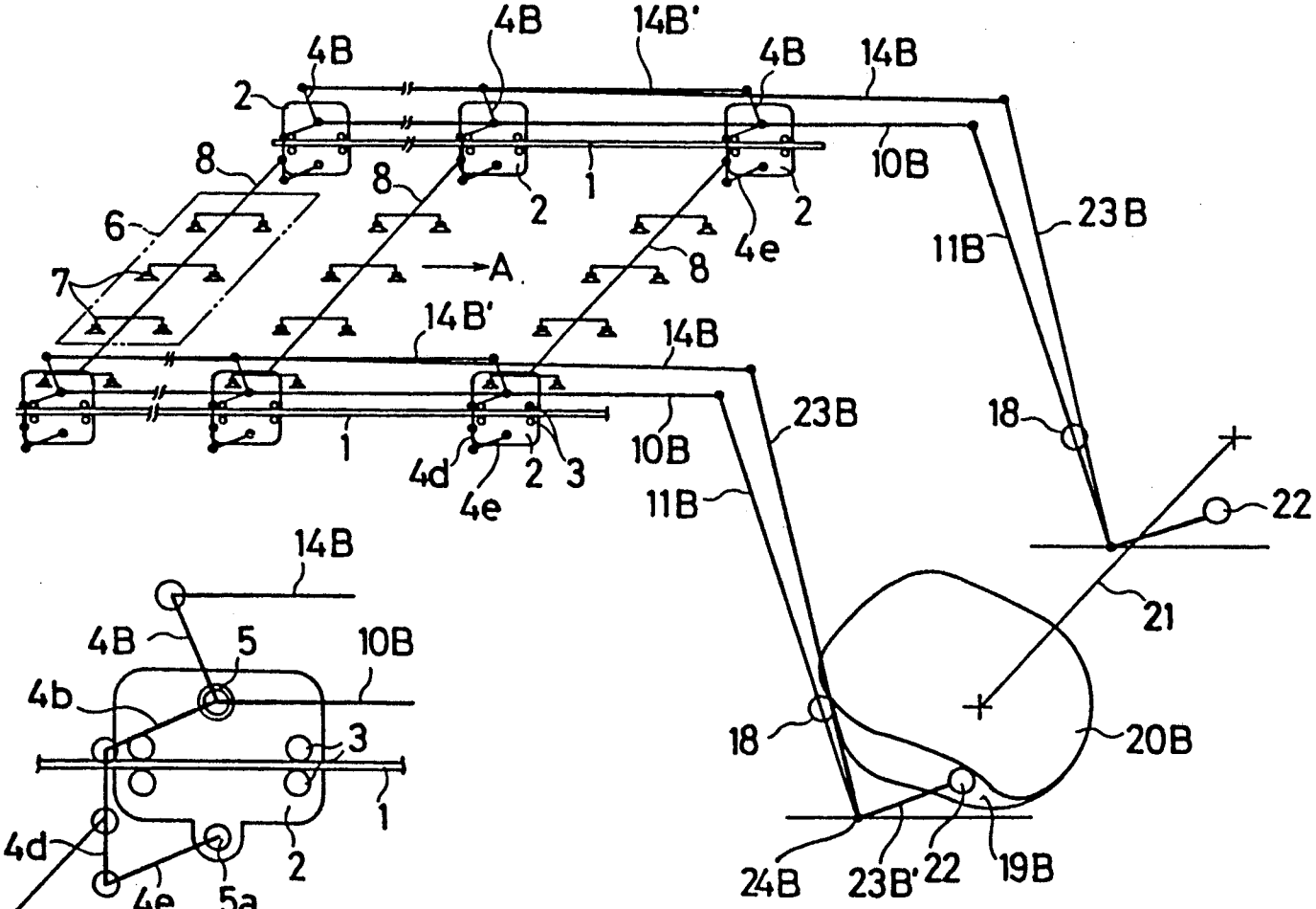
FIG. 6 is a schematic diagram of the structure of a third embodiment of the invention.
Figure 7:
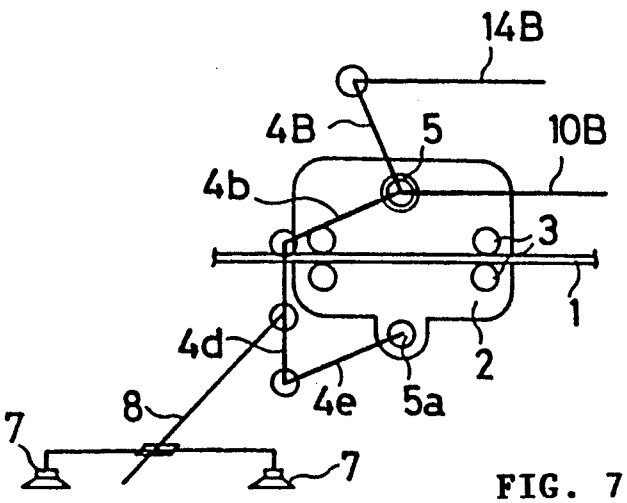
FIG. 7 is an enlarged view of the structure of a link mechanism provided in a feed carrier of the third embodiment.

FIG. 6 shows a third embodiment in which there is provided a pair of feed rails 1 within the transfer press (not shown) and a plurality of feed carriers 2 are spaced at given intervals along the rails 1. The feed carrier 2 has multiple pairs of rollers 3 at the bottom part thereof and the rollers 3 hold the feed rail 1 therebetween in a vertical direction, allowing the feed carrier 2 to freely travel along the rail 1. The feed carrier 2 has, as shown in FIG. 7, a bell crank shaped link 4B whose bent base part is pivotally attached to the inner face of the feed carrier 2 with the pin 5. Provided underneath the bell crank shaped link 4B is a sub link **4*e* which is in parallel with one side 4*b* of the link 4B and whose base end is pivotally attached to the feed carrier 2 with a pin 5*a*. The other end of the sub link 4*e* is pin-connected to one end of the parallel side 4*b* of the link 4B by a connecting link 4*d*. One end of the transfer bar 8 having the workpiece holding means 7 such as vacuum cups is attached to the mid position of the connecting link 4*d* while the other end thereof is attached, in the same manner, to the connecting link 4*d* of the feed carrier 2 positioned opposite the former feed carrier 2 so that the transfer bar 8 is transversely spanned between the opposite feed carriers 2**.

A feed equalizing bar 10B is provided to connect the pins 5 of the feed carriers 2 to one another, each pin 5 pivotally attaching the link 4B to the feed carrier 2, while a lift equalizing bar 14B is provided to connect the links 4B to one another at the upper ends thereof.

The downstream end of the feed equalizing bar 10B is pivotally attached to the upper end of a feed lever 11B and the downstream end of the lift equalizing bar 14B is to the upper end of a lift lever 23B. The reference numeral 14B' represents a sub lift equalizing bar.

The feed lever 11B and the lift lever 23B are pivotally attached, at the lower ends thereof, to the bottom of the cam box (not shown) disposed at the downstream by means of a pin 24B. These levers 11B and 23B are rocked by a feed cam 19 and a lift cam 20B both housed in the cam box through cam followers 18 and 22 which are attached to the feed lever 11B and the lift lever 23B. The lift lever 23B is designed such that it is bent at the base end thereof to form a lever part 23B' the end of which is provided with the cam follower 22.

In this embodiment, the base ends of the feed lever 11B and the lift lever 23B are pivotally mounted on the same axis and therefore a arresting cylinder (not shown) or the similar member is provided as auxiliary means for maintaining the contacting and follow-up operation of the cam followers 18 and 22 in relation to the cams 19B and 20B. Alternatively, grooved cams may be used in place of the cams 19B and 20B in order that the cam followers 18 and 22 may be operated by them.

In the transfer feeder according to the third embodiment, the lift cam 20B and the feed cam 19B mounted on the cam shaft 21 are rotated, and the lift lever 23B is then rocked by the rotation of the lift cam 20B. By means of the lift equalizing bar 14B connected to the upper end of the lift lever 23, the bell crank shaped link 4B in the feed carrier 2 is rotated counterclockwise on the pin 5, letting the transfer bar 8 down to absorb and hold the workpiece 6 by the workpiece holding means 7 attached to the transfer bar 8. The transfer bar 8 is transversely disposed between the connecting links **4*d*** which compose a freely movable part in the form of a parallelogram.

Thereafter, the lift lever 23B is rocked in the feeding direction A owing to the rotation displacement of the lift cam 20B. This rocking movement is transmitted to the lift equalizing bar 14B attached to the lever 23B so as to rotate the links 4B and 4*d* clockwise, lifting the transfer bar 8. The workpiece 6 is then lifted by the workpiece holding means 7. In the meantime, the feed lever 11B is rocked downstream by the feed cam 19B, and the feed carrier 2 is moved in the feeding direction A by the feed equalizing bar 10B connected thereto, during which the workpiece 6 is continuously lifted and conveyed in the feeding direction A.

After the workpiece 6 is conveyed by a specific distance, the lift lever 23B is rocked upstream by the lift cam 20B. This rocking movement is transferred to the lift equalizing bar 14B so as to rotate the links 4B and 4*d* counterclockwise, letting the transfer bar 8 down. The workpiece 6, which has been lifted, is then conveyed to the following process station. After the workpiece 6 is released from the workpiece holding means 7, the lift lever 23B and the feed lever 11B are reversely rotated and rocked by the lift cam 20B and the feed cam 19B, thereby returning the feed carrier 2 to its initial position.

In the above arrangement, the end of the transfer bar 8 is fixed to the connecting link 4*d* for connecting the ends of the link 4B and the sub link 4*e* which are attached to the feed carrier 2 and form the parallelogramatic part. Therefore there is such an advantage that the holding condition of the workpiece 6 is securely maintained.

Figure 8:
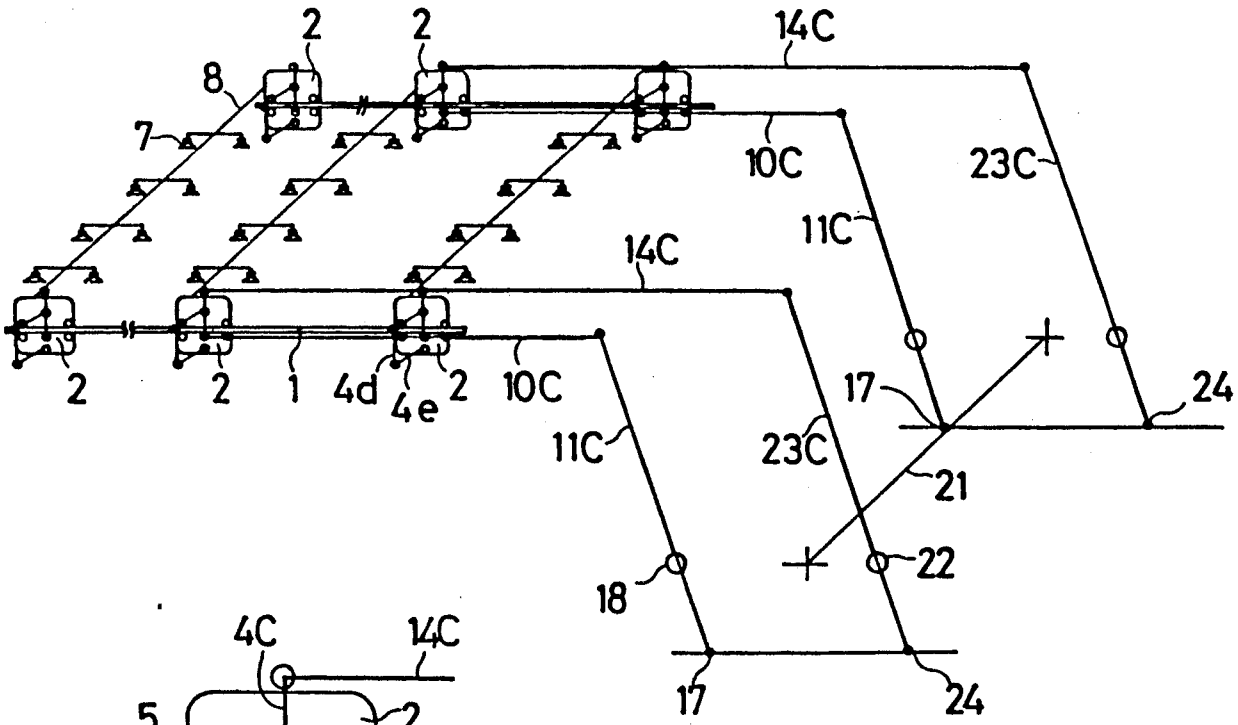
FIG. 8 is a schematic diagram of the structure of a forth embodiment of the invention.

FIG. 8 shows a forth embodiment in which a lift lever 23C and a feed lever 11C corresponding to the lift cam and the feed cam respectively are provided (these cams are substantially identical with those in the first embodiment and are not shown in the drawing). Like the first embodiment, the lower ends of these levers 11C and 23C are pivotally attached to the bottom of the cam box (not shown) with the pins 17 and 24 while the upper ends of the levers and 11C are connected to the ends of the lift equalizing bar 14C and the feed equalizing bar 10C respectively. The feed carrier 2 coupled to the feed equalizing bar 10C is identical with that of the foregoing embodiments and is represented by the same reference numeral.

Figure 9:
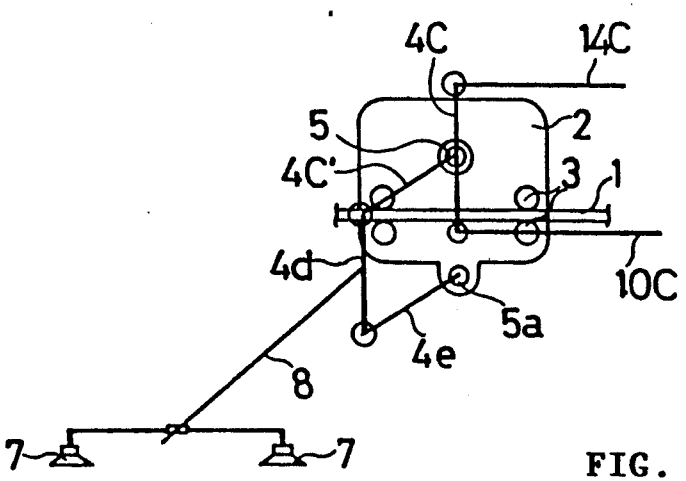
FIG. 9 is an enlarged view of the structure of a link mechanism provided in a feed carrier of the forth embodiment.

The link 4C attached to the feed carrier 2 and intended for lifting and lowering the transfer bar 8 is, as shown in FIG. 9, pivotally supported by the pin 5 at the mid position thereof. From the above supporting point, a branch link 4C' extends downwards at an appropriate tilt angle. The forward end of the branch link 4C' is connected to the forward end of the sub link 4*e* by means of the connecting link 4*d* and the other end (i.e., base end) of the sub link 4*e* is supported by the pin 5*a* at the lower part of the feed carrier 2 so that a parallelogram is formed by these links. Fixed to the mid position of the connecting link 4*d* is one end of the transfer bar 8. In this embodiment, the lift cam and the feed cam are firstly rotated, and while the lift equalizing bar 14C is operated through the lift lever 23C in order to lift or lower the transfer bar 8 with the workpiece 6, the feed equalizing bar 10C connected to the lower end of the link 4C is moved to and fro. Meanwhile, the displacement of the movement of the feed equalizing bar 10C is offset at the side of the feed cam for operating the cam follower 18 connected to the feed lever 11C so that the feed carrier 2 is moved a required distance through the pin 5 of the link 4C and the conveying operation of the workpiece 6 is smoothly performed.

With the above arrangement, by means of the feed equalizing bar 10C connected to the feed lever 11C, the feed carrier 2 is operated whilst by means of the lift equalizing bar 14C connected to the lift lever 23C, the link 4C of the feed carrier 2 is rotated on the pin 5 by which the link 4C is supported at the mid position thereof so that the transfer bar 8 is moved up and down by the branch link 4C', the sub link 4*e* and the connecting link 4*d* like the third embodiment. Thus, the workpiece 6 can be forwarded to the following station in a stable condition.

INDUSTRIAL APPLICABILITY

According to the invention, the transfer bar is moved up and down through the links attached to the feed carrier and therefore it is not necessary to employ a long heavy lift beam conventionally used in transfer feeders. This enables the lift operation to be performed with a small driving force and prevents high torque from working on the lift cam during the lifting operation of workpieces. This also prevents the generation of run-out due to the unstable condition at the time of the lifting and lowering operations, so that a decrease in accuracy for positioning workpieces and the generation of noise can be advantageously avoided.

Further, since torques working on the feed cam are offset by each other, it is not necessary to employ dummy cams and this can be an advantage for the simplification of the construction of the driving section.

I claim:

1. A transfer feeder system for lifting and lowering workpieces and forwarding the workpieces lifted, comprising:

at least one feed rail extending in a feed direction;

a plurality of feed carriers movably supported to travel along said feed rail;

a feed equalizing bar connecting a plurality of said feed carriers at given intervals;

the feed carriers each having a bell crank shaped link rotatably attached thereto;

a respective transfer bar supported on a respective one of each said bell crank shaped links, each said transfer bars having workpiece holding means for holding workpieces;

a lift equalizing bar extending along the feed rail, each of said bell crank shaped links being connected to said lift equalizing bar;

one end of the feed equalizing bar being operatively connected to an upper end of a feed lever, and one end of the lift equalizing bar being operatively connected to a lift lever; and means for moving said feed lever so that the feed carriers are forwarded along said rail and for moving said lift lever so that the transfer bars are lifted and lowered.

2. The transfer feeder as claimed in claim 1, wherein said means for moving includes a plurality of operating cams disposed facing each other, said operating cams pivotally rocking each of the feed lever and the lift lever back and forth over respective pivot points.

3. The transfer feeder as claimed in claim 1, wherein each said bell crank shaped link is rotatably attached to said feed carrier by being pivotally attached at a base part thereof to the respective feed carrier, and said transfer bar is supported on a respective one of each said bell crank shaped links by one end of each said bell crank shaped link being directly connected by a pin to one end of the respective transfer bar and each of said bell crank shaped links is connected to said lift equalizing bar by a second end of each of the bell crank shaped link being connected by a pin to the lift equalizing bar.

4. The transfer feeder as claimed in any of claims 1 through 3, wherein said one end of the lift equalizing bar is operatively connected to the upper end of the lift lever by the upper end of the lift lever being connected to a connecting rod, said connecting rod being connected to a lower end of a rocking link, said rocking link being pivotally attached to the feed lever at a mid position of the rocking link, and an upper end of the rocking link being connected to said one end of the lift equalizing bar.

5. The transfer feeder as claimed in any of claims 1 through 3, wherein said one end of the lift equalizing bar is operatively connected to the upper end of the lift lever by the upper end of the lift lever being connected to a connecting rod, said connecting rod being connected to a mid position of a rocking link, said rocking link a lower end of the rocking link being pivotally attached to the feed lever, and an upper end of the rocking link being connected to said one end of the lift equalizing bar.

6. The transfer feeder as claimed in claim 1 or 2, wherein each feed carrier is provided with a second link which has one end pivotally attached to the feed carrier, said second link being in parallel with a first side of the bell crank shaped link a first end of a coupling link being pivotally connected to a second end of the second link and a second end of the coupling link being pivotally connected to one end of the bell crank shaped link, and each of said transfer bar is supported on the respective bell crank shaped link by being directly connected to a mid position of said coupling link.

7. The transfer feeder as claimed in claim 2, wherein said operating cams are each rotatably supported so as to rotate around the same axis of rotation.

8. The transfer feeder as claimed in claim 7, wherein each said operating cams are supported on a single cam shaft extending along said axis of rotation.

9. The transfer feeder as claimed in claim 8, wherein said feed lever and said lift lever each have a respective cam follower supported thereon, the respective cam follower on said lift lever contacting a first of said operating cams and the respective cam follower on said feed lever contacting a second of said operating cams.

* * * * *